US005287146A

United States Patent [19]

Uno et al.

[11] Patent Number: 5,287,146

[45] Date of Patent: Feb. 15, 1994

[54] CONTACT TYPE CHARGING DEVICE HAVING VOLTAGE LIMITER

[75] Inventors: Koji Uno, Kawasaki; Yasuo Tanaka, Machida; Tateki Oka, Atsugi; Hitoshi Saito, Machida, all of Japan

[73] Assignee: Minolta Camera Kabushiki Kaisha, Osaka, Japan

[21] Appl. No.: 906,458

[22] Filed: Jun. 30, 1992

[30] Foreign Application Priority Data

Jul. 1, 1991 [JP] Japan ..... 3-186896
Jul. 3, 1991 [JP] Japan ..... 3-162586

[51] Int. Cl.[5] ..... G03G 15/00; G03G 15/16

[52] U.S. Cl. ..... 355/219; 355/274; 355/277; 361/225

[58] Field of Search ..... 355/219, 274, 275, 277; 361/225, 235; 323/908

[56] References Cited

U.S. PATENT DOCUMENTS 3,879,120 4/1975 Kurokawa et al. ..... 355/274
3,924,943 12/1975 Fletcher ..... 355/274
4,383,752 5/1983 Kisler ..... 361/225
4,466,732 8/1984 Folkins ..... 355/251
4,565,438 1/1986 Folkins ..... 355/251
4,631,470 12/1986 Bingley ..... 323/908 X
4,977,430 12/1990 Florack et al. ..... 355/274
5,084,740 1/1992 Simizu ..... 355/219 X

FOREIGN PATENT DOCUMENTS 0428172 5/1991 European Pat. Off. ..... 355/274
0476981 3/1992 European Pat. Off. ..... 355/219
56-35159 4/1981 Japan .

*Primary Examiner*—A. T. Grimley
*Assistant Examiner*—Robert Beatty
*Attorney, Agent, or Firm*—Burns, Doane, Swecker & Mathis

[57] ABSTRACT

A contact type charging device having a contact member for making contact with the surface of a charge bearing member so as to apply an electric charge to the surface in an image forming apparatus of the electrophotographic type, and having a charging device which has a high resistance resistor connected serially to the contact member so as to apply a voltage to the contact member. The contact type charging device has a regulating member for regulating the upper limit of the absolute value of the voltage applied to the contact member to prevent excessive current flow to the contact member, or has a regulating member for regulating the lower limit of the absolute value of the voltage applied to the contact member to prevent a greater than necessary drop of the voltage applied to the charge bearing member.

16 Claims, 12 Drawing Sheets

FIG.1(A) PRIOR ART
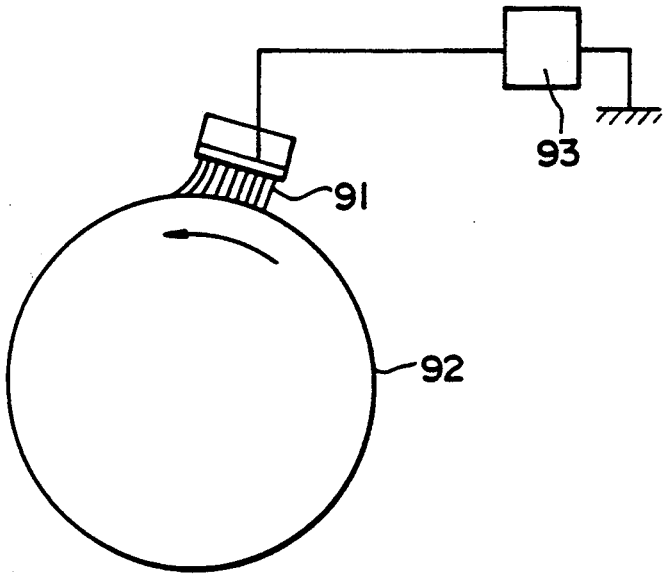
FIG.1 (B) PRIOR ART
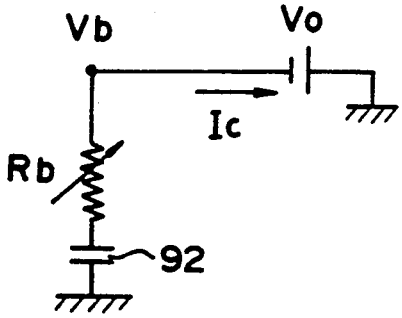

FIG.2 (A) PRIOR ART
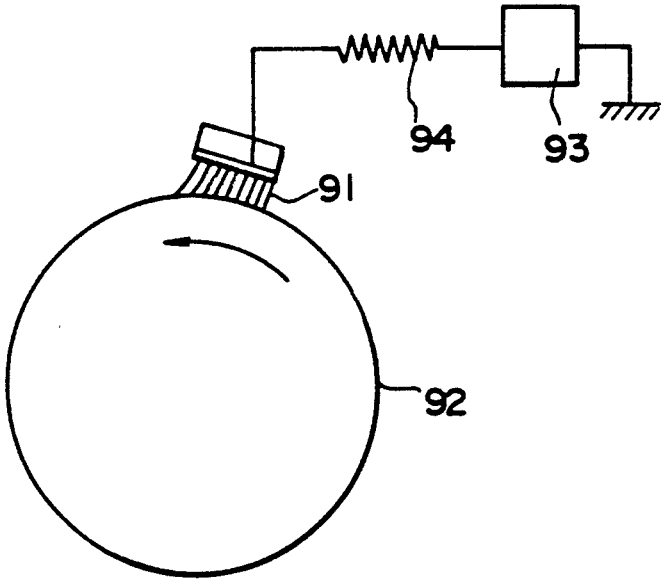
FIG.2 (B) PRIOR ART
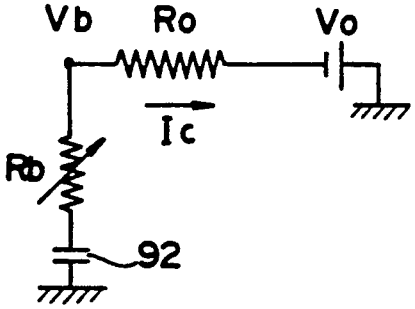

CONTACT TYPE CHARGING DEVICE HAVING VOLTAGE LIMITER

BACKGROUND OF THE INVENTION

Field of the Invention

The present invention relates to a contact type charging device for imparting an electrical charge to a charge receiving member, for example, an electrostatic latent image bearing member or toner image transfer member, in an electrophotographic image forming process, and more specifically relates to a contact type charging device used in electrophotographic type copying apparatus, printers and the like wherein contact is made with the surface of an electrostatic latent image bearing member to impart an electrical charge to said surface prior to the formation of an electrostatic latent image thereon, and wherein contact is made with a transfer member to transfer to a transfer member a toner image formed on the surface of an electrostatic latent image bearing member.

Description of the Related Art

Generally, in copying apparatus and printers of the electrophotographic type, a corona charger is used as the charging device for toner image transfers and charging the electrostatic latent image bearing member. In recent years, however, organic photosensitive members have been used as electrostatic latent image bearing members, the charging potential of said organic photosensitive members having a negative polarity, whereas a corona charger produces ozone ($O_3$) or nitrous oxides ($NO_x$) via the corona discharge requiring a large current of negative polarity, which is disadvantageous in terms of environmental pollution.

Alternative proposals include charging devices of the contact type which impart electrical charges by having an electrically conductive brush, roller, blade and the like come into contact with a transfer member or an electrostatic latent image bearing member such as a photosensitive member and the like, wherein a voltage is applied to the member via said contact. Such charging devices of the contact type do not produce environmental pollutants such as ozone and the like.

The amount of the electrical charge imparted to the electrostatic latent image bearing member, e.g., photosensitive member, through the amount of electrical current varies greatly in accordance with the contact type of charging device. The amount of the aforesaid electric current affects the resistance value of the contact element of the charging device, i.e., the charging brush and the like that make contact with the electrostatic latent image bearing member, said resistance value varying in accordance with environmental conditions such as temperature and humidity.

An example of a brush charging device is shown in FIG. 1A. The charge brush 91 of the aforesaid device is arranged so as to make contact with the surface of the rotatably driven electrostatic latent image bearing member (photosensitive drum in this instance) 92, and a voltage is applied to said brush from a power supply 93. When the total resistance of the brush 91 including all brush fibers is expressed as Rb and the power supply voltage is expressed as Vo, the equivalent circuit is as shown in FIG. 1B. Vb is the voltage applied to the brush 91. In this circuit, the charging current Ic supplied to the brush 91 is expressed as Vb/Rb. Since Vb=Vo (constant), when the brush resistance Rb changes, the current Ic changes as indicated by line B in FIG. 3.

Environmental conditions were set at highs H/H (high temperature/high humidity of 30° C. and 85% relative humidity RH) and lows L/L (low temperature/low humidity of 10° C. and 15% relative humidity RH). When the brush voltage Vb was changed experimentally under the aforesaid environmental conditions, the actual changes in the charge current Ic are expressed by line H/H (high temperature/high humidity) and line L/L (low temperature/low humidity) in FIG. 3.

Accordingly, under the aforesaid H/H and L/L conditions when the brush voltage Vb=Vo, the dispersion of the charge current Ic is expressed as b in FIG. 3. The charging potential of the surface of the photosensitive drum 92 changes depending on the environmental conditions, and results in a dispersion in image density.

In addition to the aforesaid disadvantage caused through environmental fluctuations, further disadvantages arise when, for example, the surface of the photosensitive drum 92 has pin holes. When the conductive substrate is exposed on the photosensitive drum 92 through the aforesaid pin holes, the brush 91 comes into contact with said conductive substrate such that a leak is produced between the brush 91 and the substrate of the photosensitive drum. This leak causes excessive current to flow to the brush 91 which may damage or burn the brush 91.

The methods considered to eliminate the previously described disadvantages include connecting a resistor 94, which has a very large resistance value compared to the resistance of the brush 91, between the power supply 93 and the charge brush 91, as shown in FIG. 2A. In this case, if the resistance value of the additional resistor is Ro, the equivalent circuit can be expressed as in FIG. 2B. Accordingly, the charge current Ic equals Vo/(-Ro+Rb), and when the resistance value Ro is made greatly larger than the value Rb there is minimal fluctuation in the current Ic regardless of some fluctuation in the value Rb due to environmental changes. Therefore, the dispersion of the surface potential of the photosensitive drum induced through environmental changes can be controlled and minimized.

When the brush voltage Vb fluctuates, the theoretical change in the current Ic can be expressed by line A in FIG. 3. Actually, the aforesaid line A moves within a range between the previously described H/H line and the L/L line, such that the dispersion in the charge current Ic induced by environmental changes is suppressed to the range a, which is much smaller than the conventional dispersion width b.

Even when the photosensitive drum has pinholes, the current flow between the brush 91 and the substrate of the photosensitive drum is minimal, thereby allowing control of any excessive current flowing to the brush 91.

However, when a resistor 94 is interposed between the charge brush 91 and the power supply 93, current flows from the power supply 93 while the photosensitive drum 92 is stopped, the photosensitive drum 92 is overcharged which causes insulation breakdown of the photosensitive drum 92 and deterioration of the photosensitive member characteristics, and giving rise to the disadvantage of adherence of reverse-charged toner during reverse developing. Furthermore, when the transfer paper is wrapped on the photosensitive drum 92 and extremely large contact resistance is produced between the brush 91 and the photosensitive drum 92, causing a rise in the charge brush potential and leakage to peripheral components.

An example of a transfer device is described hereinafter.

In image forming apparatus of the electrophotographic type, transfer devices which transfer by feeding a recording medium between a photosensitive member and a transfer roller to which is applied a bias voltage having a polarity opposite of the toner polarity are well known as a method for transferring to a recording medium a toner image formed on the surface of a photosensitive member.

In the transfer devices of the aforesaid type, when a constant-voltage power supply is directly connected to apply a bias voltage to the transfer roller, the electrical resistance of the transfer roller itself fluctuates in accordance with environmental conditions (particularly humidity), so that when the recording medium moisture absorption state changes, the value of the electrical current flowing to the recording medium from the transfer roller (a factor of variability in transfer characteristics, hereinafter referred to as "transfer current") also changes. That is, excellent transfers may not be accomplished depending on the environment.

Transfer devices have been proposed (e.g., Japanese Laid-Open Patent Application No. 56-35159) wherein resistors having a high resistance value are connected (serially) intermediately between the transfer roller and the constant-voltage power supply.

FIG. 4 is a block diagram showing the construction of the electrophotographic image forming apparatus using the aforesaid transfer device. The image forming apparatus briefly comprises a photosensitive drum 101, charge brush 102, developing device 105, transfer device 161 of the roller type, and feed device (only guide plate 111 is labeled). The transfer device 161 of the roller type comprises a transfer roller 161*a*, power supply (constant-voltage power supply) 162, and bias resistors Rs, and supplies a voltage having the opposite polarity to the toner polarity from said power supply 162 to the transfer roller 161*a* via the bias resistors Rs. FIG. 5 illustrates an equivalent circuit of the aforesaid device. The resistor R is the combined resistors of the transfer roller 161*a*, recording medium 112 and photosensitive drum 101.

In the aforesaid transfer device, when the current flowing to the transfer roller 161*a* increases and decreases, fluctuations in the current supplied to the transfer roller 161*a* are prevented by automatically reducing or increasing the transfer bias voltage applied to the transfer roller 161*a*. That is, if the value of the bias resistors Rs is sufficiently greater than the value of the combined resistors R, the change in the transfer current is only slight even if the electric capacity of the recording medium changes.

In the transfer device 161 of the previously described construction, however, when current from the transfer roller 161*a* leaks so as to excessively flow to the guide plate 111 or the like of the image forming apparatus frame on high humidity conditions and is conducted to the surface of the recording medium 112, a greater than necessary voltage drop is produced by the bias resistor Rs, whereupon the required voltage is no longer applied to the transfer roller 161*a*. Therefore, sufficient transfer current does not flow to the recording medium 112 and suitable transfer is not accomplished.

SUMMARY OF THE INVENTION

A main object of the present invention is to provide a contact type charging device capable of applying a stable desired electric charge to the surface of a charge bearing member in an image forming apparatus of the electrophotographic type.

Another object of the present invention is to provide a contact type charging device capable of preventing damage to the contact member by excessive current flow.

A further object of the present invention is to provide a contact type charging device capable of preventing overcharging of the surface of the charge bearing member and current leakage to peripheral components.

A still further object of the present invention is to provide a contact type charging device capable of preventing a greater than necessary drop of the voltage applied to a charge bearing member on high temperature/high humidity conditions.

These and other object of the present invention are achieved by providing a contact type charging device which makes contact with the surface of a charge bearing member so as to apply an electric charge to said surface in an image forming apparatus of the electrophotographic type, said contact type charging device comprising a contact member for making contact with said charge bearing member, a resistor connected serially to said contact member, voltage applying means for applying a voltage to said contact member via said resistor, and regulating means for regulating the upper limit of the absolute value of the voltage applied to said contact member.

These and other objects of the present invention are achieved by providing a contact type charging device which makes contact with the surface of a charge bearing member so as to apply an electric charge to said surface in an image forming apparatus of the electrophotographic type, said contact type charging device comprising a contact member for making contact with said charge bearing member, a resistor connected serially to said contact member, voltage applying means for applying a voltage to said contact member via said resistor, and regulating means for regulating the lower limit of the absolute value of the voltage applied to said contact member.

These and other objects, advantages and features of the invention will become apparent from the following description thereof taken in conjunction with the accompanying drawings which illustrate specific embodiments of the invention.

BRIEF DESCRIPTION OF THE DRAWINGS

In the following description, like parts are designated by like reference numbers throughout the several drawings.

FIG. 1A is an illustration showing a conventional brush charging device;

FIG. 1B is an illustration showing the equivalent circuit of the device in FIG. 1A;

FIG. 2A is an illustration showing an improvement of the device of FIG. 1A;

FIG. 2B is an illustration showing the equivalent circuit of the device of FIG. 2A;

DETAILED DESCRIPTION OF THE PREFERRED EMBODIMENTS

Figure 6:
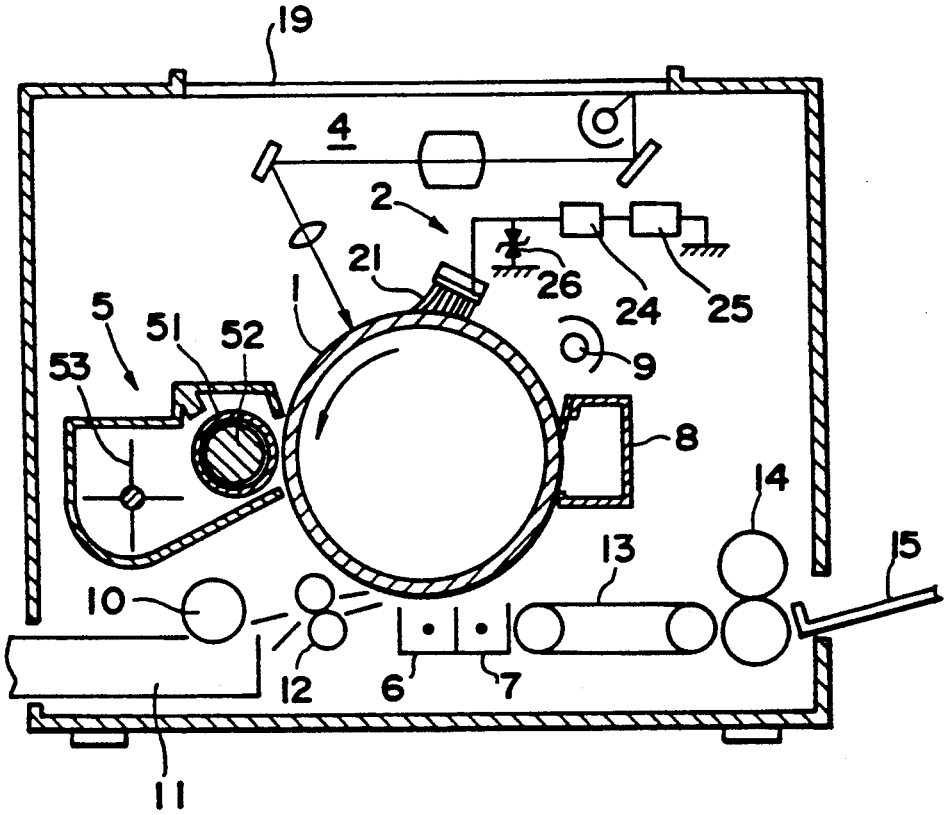
FIG. 6 is a brief section view of a copying apparatus incorporating a first embodiment of the present invention.

The preferred embodiments of the present invention are described hereinafter with reference to the accompanying drawings. FIG. 6 shows a first embodiment of the contact type charging device of the present invention, and more specifically shows a charging device for charging a photosensitive drum and a copying apparatus incorporating said charging device.

The aforesaid copying apparatus is provided with a photosensitive drum 1. The photosensitive drum 1 is a well known organic photosensitive member of the laminate type and the surface of which is provided with an organic photosensitive outermost layer. In the drawing, the photosensitive drum 1 is rotatably driven in the counterclockwise direction at a system speed (drum circumferential speed) of 150 mm/second. The image forming elements described hereinafter are arranged around the photosensitive drum 1 in the direction of rotation.

Figure 7:
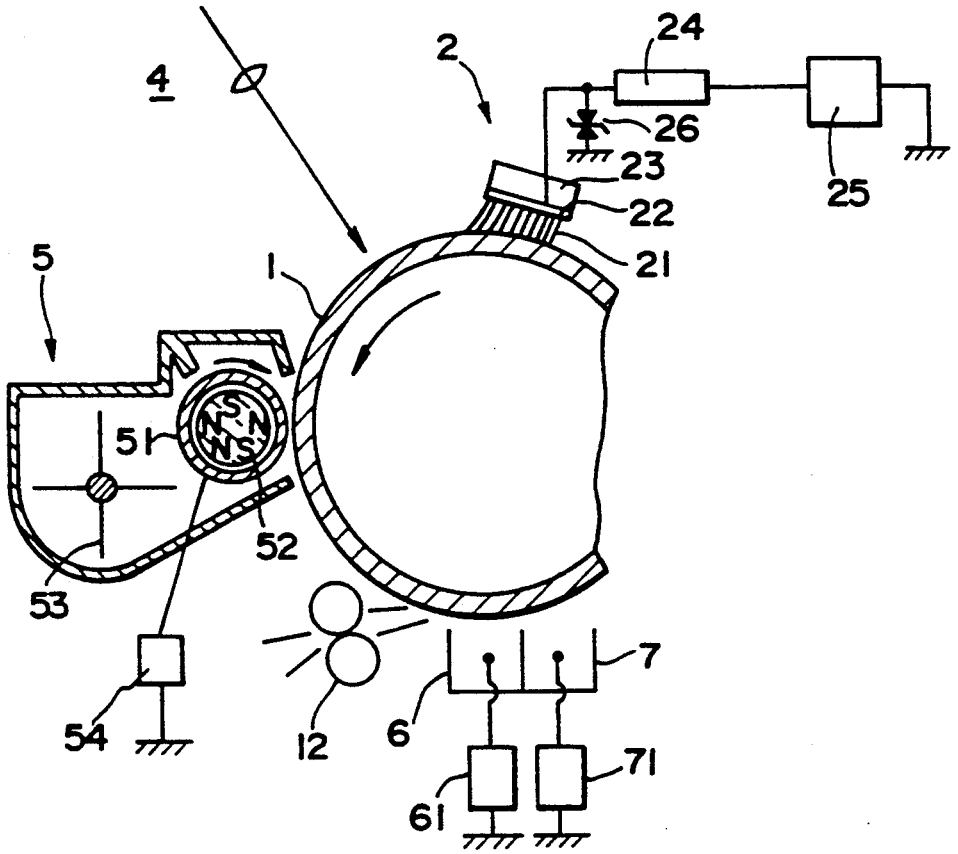
FIG. 7 shows details of the construction of a part of the copying apparatus of FIG. 6.

(1) Brush charging device 2 of an embodiment of the present invention:

The brush charging device 2 imparts an electrical charge to the surface of the photosensitive drum 1 to achieve a predetermined electric potential on said surface. The brush charging device 2 comprises a charge brush 21 for making contact with the surface of the photosensitive drum 1, conductive support plate 23 for supporting the brush 21, constant-voltage power supply 25 connected to the support plate 23 via a resistor 24, and varistor 26 connected at a point between the resistor 24 and the brush 21, as shown in FIGS. 6 and 7.

The resistor 24 has a resistance of 150 MQ, and the power supply 25 is a direct current (DC) power source supplying −2.0 kV.

The charge brush 21 comprises conductive fibers such as rayon, nylon and the like containing carbon, which are embedded in a conductive fabric 22 fixedly attached to the support plate 23. The fibers of the brush 21 have a thickness of about 30 μm and a length of 5 mm. The total resistance value of the brush 21 is $5\times10^6$ Q per 1 cm length in the rotational axis direction of the photosensitive drum when 1 kV voltage is applied. The spacing between the support plate 23 and the photosensitive drum 1 is set at 4 mm, i.e., set so that the brush 21 pressed the surface of the drum 1 by about 1 mm.

Figure 3:
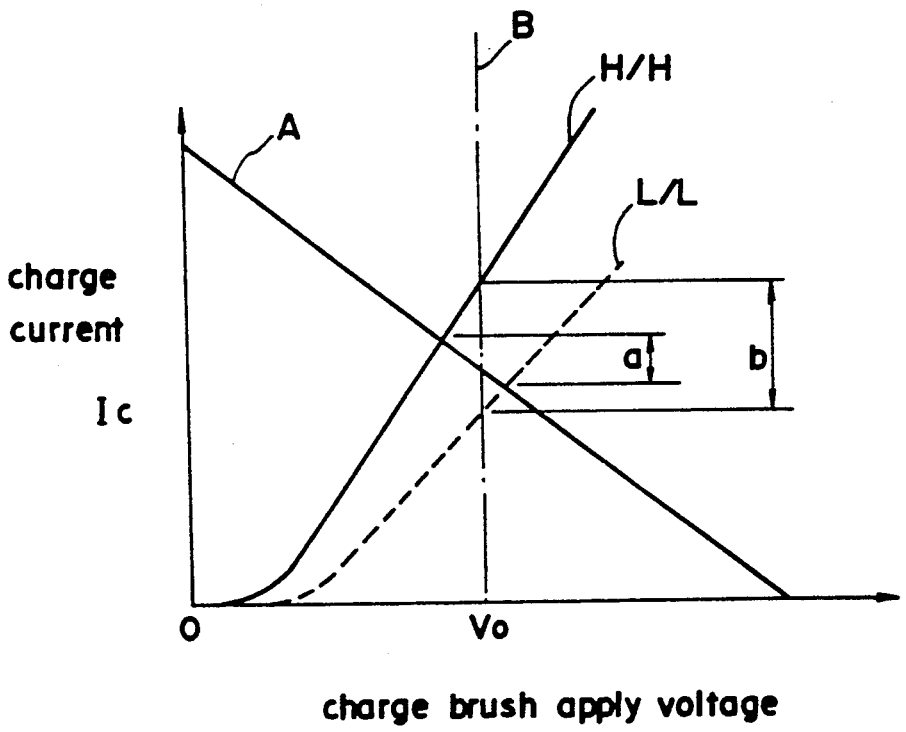
FIG. 3 is a graph showing the relationship between the charge current and the voltage applied to the charge brush of the charging device shown in FIGS. 1 and 2.
Figure 4:
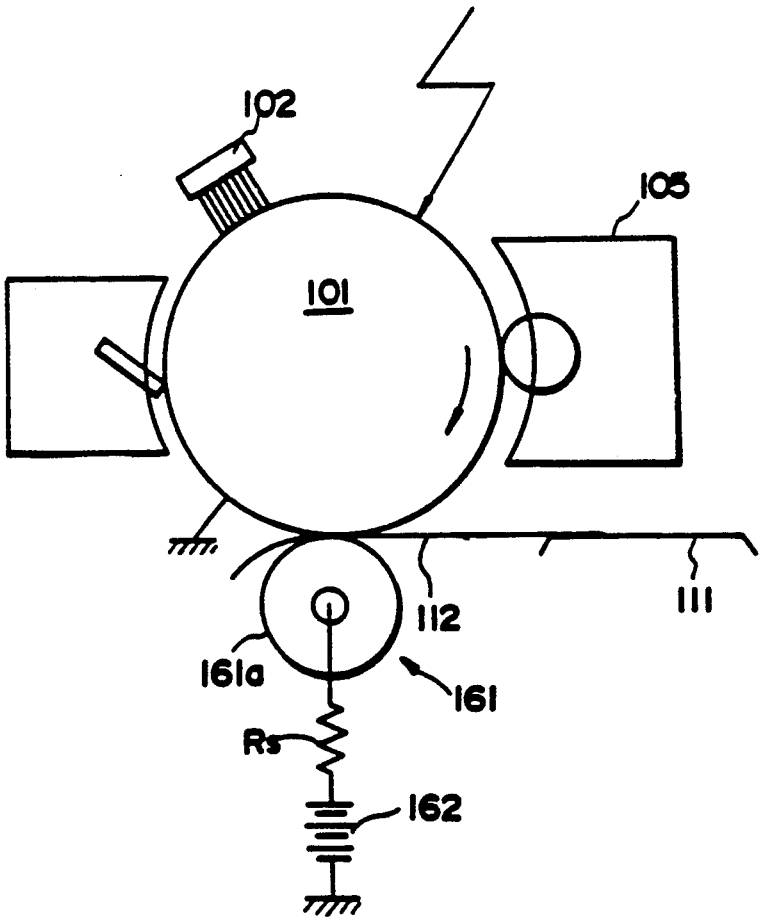
FIG.4 PRIOR ART
FIG. 4 is a block diagram showing an electrophotographic copying apparatus including a conventional roller transfer device.
Figure 5:
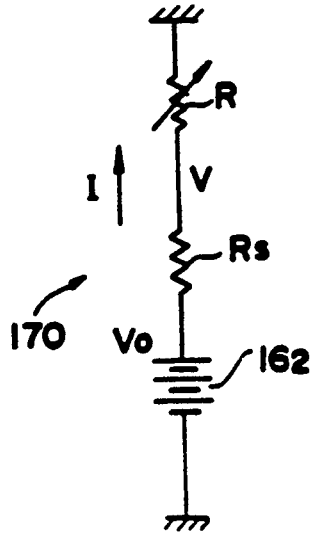
FIG.5 PRIOR ART
FIG. 5 shows an equivalent circuit of a conventional roller transfer device.
Figure 8:
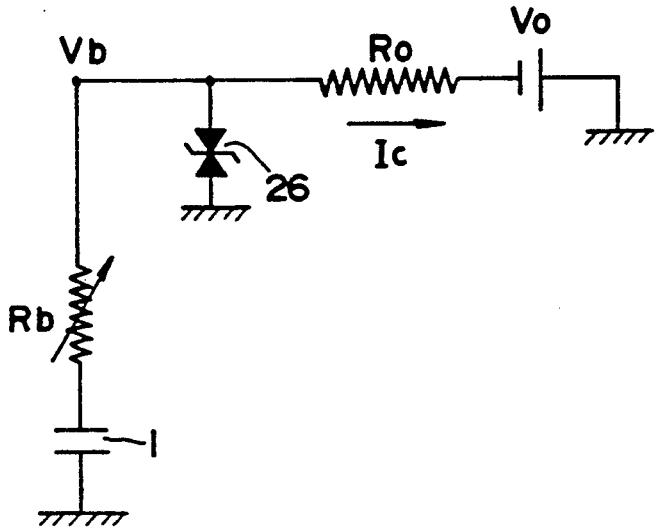
FIG. 8A shows an equivalent circuit for the embodiment of the charging device of FIG. 1.
FIG. 8B is a graph showing the relationship between the charge current and the voltage applied to the charge brush.
Figure 8B:
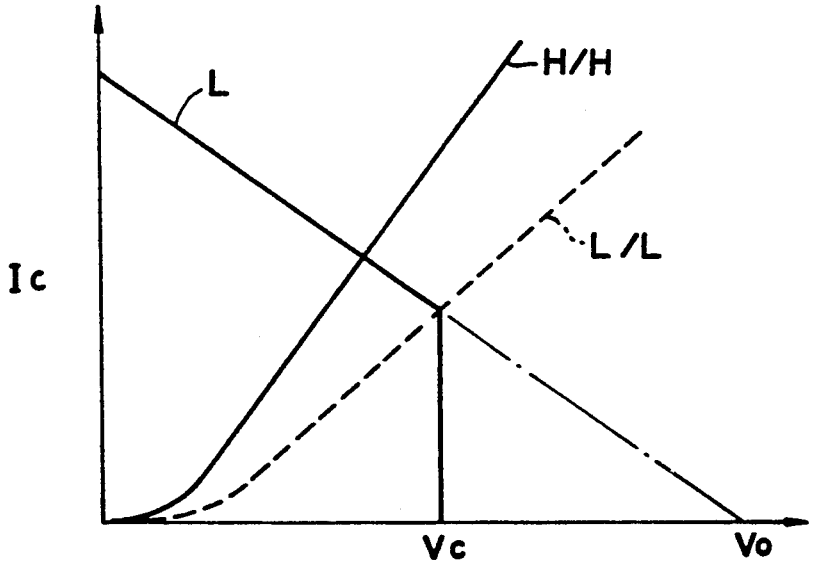

If the resistance of the brush 21 which changes in response to environmental changes is designated Rb, the voltage applied to the brush 21 is designated Vb, the resistance value of the resistor 24 is designated Ro, and the voltage of the power supply 25 is designated Vo, the equivalent circuit of the charging device 2 is as shown in FIG. 8A. When the voltage Vb changes, the theoretical change in the charge current Ic is expressed by line L in FIG. 8B. In FIG. 8B, lines H/H and L/L are identical to the lines H/H and L/L of FIG. 3. The upper limit voltage applied to the charge brush 21 by the varistor 26 is regulated at Vc (varistor voltage), said voltage being set at the intersection position with line L/L, or slightly beyond said intersection position.

(2) Image exposure optical system 4

The optical system 4 projects an image of an original document disposed on the glass document platen 19 through lenses and mirrors onto the surface of the photosensitive drum 1 so as to form a positive electrostatic latent image thereon.

(3) Developing device 5

The developing device 5 is a well known magnetic brush type device provided with a developing material mixing/transporting means 53 and developing sleeve 51 functioning as a developing electrode. As shown in FIGS. 6 and 7, the developing sleeve 51 has a built in magnetic roller 52 which is rotatably driven in the clockwise direction in the drawing, and is connected to the power supply 54 which supplies a bias voltage thereto, as shown in FIG. 7. The developing material comprises a mixture of a magnetic carrier and an insulated toner. The toner is triboelectrically charged with the opposite polarity to that of the charging device 2. A developing bias voltage having the same polarity as the charge brush 21 is supplied from the power supply 54 to the developing sleeve 51.

The power supply 54 is a Dc power source supplying −250 V, and the toner is a positive polarity toner.

(4) Transfer charger 6

The transfer charger 6 imparts an electric field to act on the copy paper passing and adhered to the bottom of the photosensitive drum 1, and the toner image formed by the aforesaid developing device 5 is transferred onto said copy paper. As shown in FIG. 7, a reverse polarity voltage to that of the charge polarity of the insulated toner is applied to the charge wire from the power supply 61.

The power supply 61 is a DC power source supplying −6.0 kV.

(5) Separation charger 7

The separation charger 7 eliminates the charge imparted to the copy paper by the transfer charger so as to separate the copy paper from the surface of the photosensitive drum 1 after the toner image transfer. As shown in FIG. 7, an alternating current (AC) voltage is supplied form the power supply 71 to the charge wire.

The power supply 71 is an AC power source supplying ±5.7 kV (RMS) at 400 Hz.

(6) Cleaning device 8

The cleaning device 8 removes residual toner from the surface of the photosensitive drum 1 by means of a blade.

(7) Eraser lamp 9

The eraser lamp 9 removes the residual electric charge remaining on the surface of the photosensitive drum 1 by means of a light exposure.

On the other hand, the copy paper is prestacked in the automatic feed cassette 11, the uppermost sheet of the stack is fed sheet by sheet by means of the rotation of the feed roller 10, and is transported to the transfer portion synchronously with the toner image formed on the drum 1 with a predetermined timing via the timing roller 12. After the transfer is completed, the copy sheet is transported to the fixing device 14 by a transport belt 13 provided with an air suction means (not illustrated), and after the toner image is fixed thereon the copy sheet is discharged to a discharge tray 15.

The device described above was installed in a copying apparatus and the charge potential on the surface of the photosensitive drum 1 imparted by the charging device 2 was checked; the findings are described below. N/N indicates the normal environmental conditions (20° C., 60% RH); H/H indicates high temperature/-high humidity conditions (30° C., 85% RH); and L/L indicates the low temperature/low humidity conditions (10° C., 15% RH). Drum surface charge potential under conditions N/N, H/H and L/L N/N: −700 V
H/H: −730 V
L/L: −650 V
Difference Δ between H/H and L/L=80 V Even when environmental conditions change from L/L to H/H the fluctuation is only 80 V. This level of change does not effect the image.

Excessive current flow to the brush 21 is suppressed even in the presence of pinholes and the like in the surface of the photosensitive drum 1 because the high resistance resistor 24 is provided. Therefore, the anxiety of damage to and burning of the brush 21 by an excessive current is alleviated.

Furthermore, because the upper limit of the voltage applied to the charge brush 21 is regulated at the voltage Vc via the varistor 26, (1) overcharging of the drum 1 is prevented even if current is supplied by the power supply 25 while the drum 1 is stopped for whatever reason, and
(2) current leakage from the charge brush 21 to peripheral components is avoided even when an extremely large contact resistance is produced because a copy sheet is wrapped around the photosensitive drum 1 and is interposed between the charge brush 21 and the drum 1.

The charge potential of the surface of the photosensitive drum 1 was checked under the following charging device conditions to provide comparative examples.

Resistor 24: absent
Power supply 25: negative polarity of −1.0 kV
N/N: −710 V
H/H: −790 V
L/L: −600 V
Difference Δ between H/H and L/L=190 V When environmental conditions change from L/L to H/H, the fluctuation was 190 V. This level of change greatly affected image density.

The value of the resister 24 in the charging device 2 was changed variously including the aforesaid resistor value 150 MQ. The total resistance of the charge brush 21, that is, the resistance value per centimeter in axial direction of the drum 1 times the brush length (in this case, 25 cm) was preset at 125 MQ and 50 MQ, and the changes in image density were checked under environmental conditions ranging from H/H to L/L; the findings are shown in Table 1. In Table 1, the symbol O indicates no change, the symbol Δ indicates a change, and the symbol X indicates a large change. As can be readily understood from Table 1, the value of the resistor 24 is preferably set at a value greater than the total resistance value of the charge brush 21.

TABLE 1

| total resistance | resistor 24 | | | |
|---|---|---|---|---|
| | 20 MΩ | 50 MΩ | 150 MΩ | 200 MΩ |
| 125 MΩ | x | Δ | ○ | ○ |
| 50 MΩ | Δ | ○ | ○ | ○ |

The present invention may be adapted for use in reverse developing.

Although the upper limit of the voltage applied to the charge brush 21 was regulated using the varistor 26 in the previously described embodiment, a Zener diode may alternatively be used for said voltage control instead of the aforesaid varistor.

Figure 9:
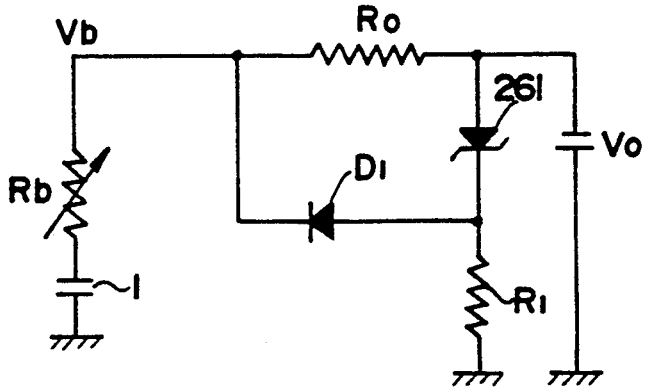
FIG. 9 shows an equivalent circuit of a modification of the charging device of the first embodiment.
Figure 10:
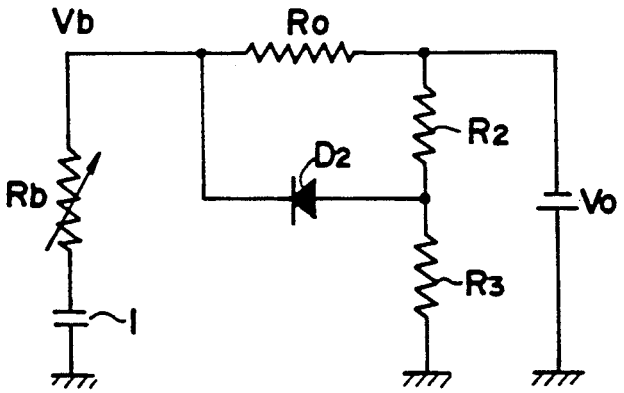
FIG. 10 shows an equivalent circuit of another modification of the charging device of the first embodiment.
Figure 11:
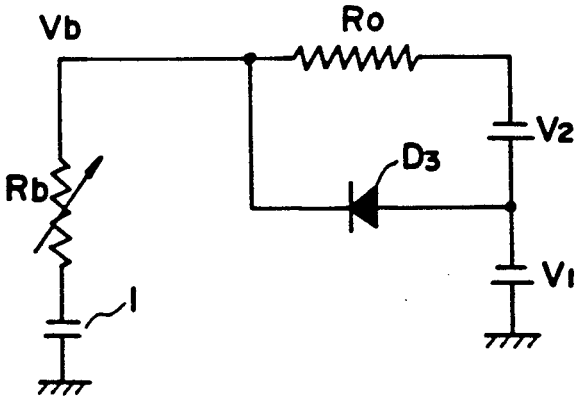
FIGS. 11 shows an equivalent circuit of still another modification of the charging device of the first embodiment.

In the preceding embodiment, the upper limit control voltage is determined from the grounded side by the varistor 26, the upper limit of the voltage applied to the charge brush 21 may be controlled by regulating the lower limit of the voltage of the aforesaid high resistance resistor 24 (resistance value Ro), as shown in FIGS. 9, 10 and 11.

In the upper limit voltage control of FIG. 9, a Zener diode 261 is used to set the upper limit control voltage from the power supply voltage Vo side. In the drawing, R1 is a resistor, and D1 is a diode. A varistor may be used instead of the Zener diode 261. In the case of this control, the voltage (Vo−Vc) of FIG. 8B corresponds with the Zener voltage.

In the control of FIG. 10, the upper limit control voltage is accomplished through divided voltage output using the resistors R2 and R3. In the drawing, D2 is a diode.

In the control of FIG. 11, the power supply 25 of the previous embodiment is constructed in two parts (voltage V1 and voltage V2 parts) to accomplish upper limit voltage control. D3 is a diode. The voltages V1 and V2 may be obtained, for example, by using two transistors or by tapping output from one transistor. In the case of this control, the voltage Vc of FIG. 8B corresponds with the voltage V1, and the voltage difference (Vo−Vc) corresponds with the voltage V2.

Although the present invention has been described above in terms of the brush charging device 2 for charging the surface of a photosensitive drum, it is to be noted that the present invention may be applied to, for example, a transfer device of the transfer roller type for transferring a toner image from a photosensitive member to a copy paper. The previously described effect of the charge brush can be obtained by preventing overcharging of the transfer roller, and preventing current leakage from the transfer roller through pinholes in the photosensitive member.

An example of preventing overcharging of the charge bearing member and excessive current flow to the contact member via the present invention have been described above.

A second embodiment of the present invention which prevents a reduction in the applied voltage of the charging device due to changes in the operating environment follows hereinafter with reference to the drawings.

Figure 12:
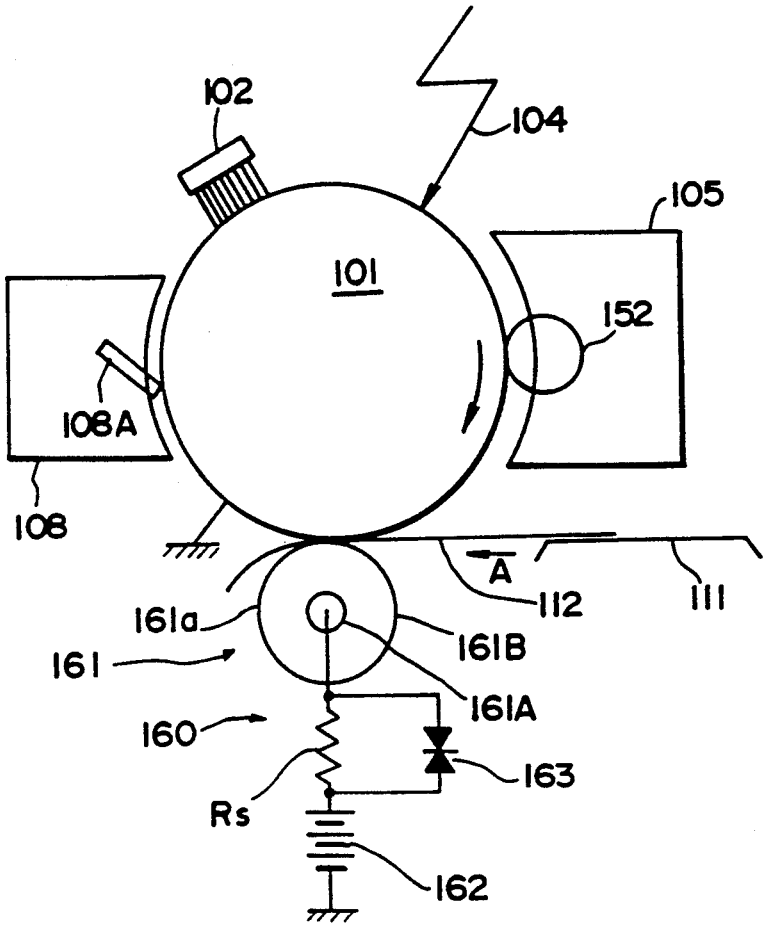
FIG. 12 is a block diagram of an electrophotographic copying apparatus incorporating a second embodiment of the roller transfer device of the invention.

FIG. 12 is a block diagram showing the roller transfer device 161 of a second embodiment of the invention installed in, for example, a laser printer. The laser printer comprises a photosensitive drum 101, charge brush 102, developing unit 105 provided with a developing sleeve 152, roller transfer device 161 having a transfer roller 161*a* provided with a shaft 161A and urethane layer 161B, guide plate 111, transfer power supply 162, bias resistor Rs, varistor 163, and cleaner 108.

The photosensitive drum 101 is cylindrical in shape, and is arranged so as to be rotatable in the clockwise direction about a shaft. Arranged around the periphery of the photosensitive drum 101 so as to be in close proximity with the surface thereof are a charge brush 102, developing device 105 and cleaner 108. The cleaner 108 is arranged on the side of the of photosensitive drum 1 opposite the side on which the developing device 105 is provided. Since the charge brush 102 is identical to the brush charging device 2 used in the previous embodiment, only the charge brush portion is shown in the drawing.

The transfer roller 161*a* is arranged so as to be rotatable while making contact with the surface of the photosensitive drum 101. The transfer roller 161*a* is provided with a shaft 161A which is electrically conductive, and a urethane layer 161B which has a high resistance value and contains a conductive material. A bias circuit 160 is connected to the aforesaid shaft 161A. The bias circuit 160 is provided with bias resistor Rs, varistor 163, and transfer power supply 162. The negative electrode of the transfer power supply 162 is grounded, and the positive electrode is connected to one end of the bias resistor Rs and the varistor 163, respectively. The other ends of the bias resistor Rs and the varistor 163 are connected to the shaft 161A of the transfer roller 161.

The surface of the photosensitive drum 101 is charged to a predetermined potential by the charge brush 102 via the clockwise rotation of the drum 101, as shown in FIG. 12. The charged photosensitive drum 101 is exposed by a laser beam 104 from the printer head (not illustrated) so as to form an electrostatic latent image on the surface of the drum 101. Toner charged with the same polarity as the latent image is supplied from the developing sleeve 152 onto the electrostatic latent image and adheres to the surface of the photosensitive drum 101.

On the other hand, the recording medium 112 is fed from a stacker (not illustrated) and guided from the guide plate 111 by the contact portion of the photosensitive drum 101 and the transfer roller 161*a*. The recording medium 112 is interposed between the photosensitive drum 101 and the transfer roller 161*a* via the rotation of the drum 101 and fed in the arrow A direction. The recording medium 112 is charged with a positive polarity through contact with the transfer roller 161*a*.

The photosensitive drum 101 continues rotation so that the toner adhering portion of the drum surface reaches the contact portion of the photosensitive drum 101 and the transfer roller 161*a*. At this position, an electrostatic force is exerted on the toner adhered to the surface of the photosensitive drum 101 by the transfer roller 161*a*, such that the toner is caused to move toward the recording medium 112. That is, the toner adhered to the surface of the photosensitive drum 101 is transferred to the recording medium 112. The recording medium 112 with the transferred toner adhered thereon is transported to a fixing device not shown in the drawings where the toner is fused onto the recording medium 112 and the image is formed.

After the aforesaid transfer, the excess toner remaining on part of the surface of the photosensitive drum 101 is removed therefrom by the blade 108A in conjunction with the rotation of the drum. The removed toner is collected within the cleaner 108.

Figure 13:
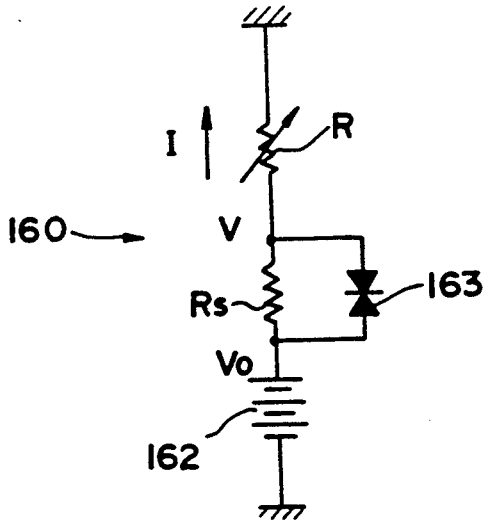
FIG. 13 shows an equivalent circuit of the roller transfer device of the embodiment of FIG. 12.

FIG. 13 shows an equivalent circuit for the roller transfer device 161 of the present embodiment. In the drawing, the resistance R is the combined resistance of the transfer roller 161*a*, recording medium 112 and the photosensitive drum 101. The resistance value of the bias resistor Rs is about 200 MQ, and the bias voltage of the varistor 163 is about 1.1 kV. The output voltage Vo of the transfer power supply 162 is about 2.1 kV.

In the aforesaid bias circuit 160, when the voltage drop in the bias resistor Rs is less than the varistor voltage of varistor 163, i.e., 1.1 kV or less, the varistor 163 is in the OFF state. Consequently, the transfer voltage V supplied to the transfer roller 161*a* is $V=Vo\times R/(R+Rs)$.

On the other hand, when the voltage drop of the bias resistor Rs is greater than 1.1 kV, the varistor 163, which is connected in parallel with the bias resistor Rs enters the ON state. When the varistor 163 is turned ON, the impedance of the varistor 163 is extremely low compared to the resistance value of the resistor Rs, and may be considered as zero. Accordingly, the voltage drop in the bias resistor Rs does not exceed about 1.1 kV. In this case, the transfer voltage V applied to the transfer roller 161*a* is $V=Vo-1.1\ kV=1\ kV$. The resistance value of the bias resistor Rs, varistor voltage of the varistor 163, and output voltage Vo of the transfer power supply 162 are not limited to the previously described values.

Figure 14:
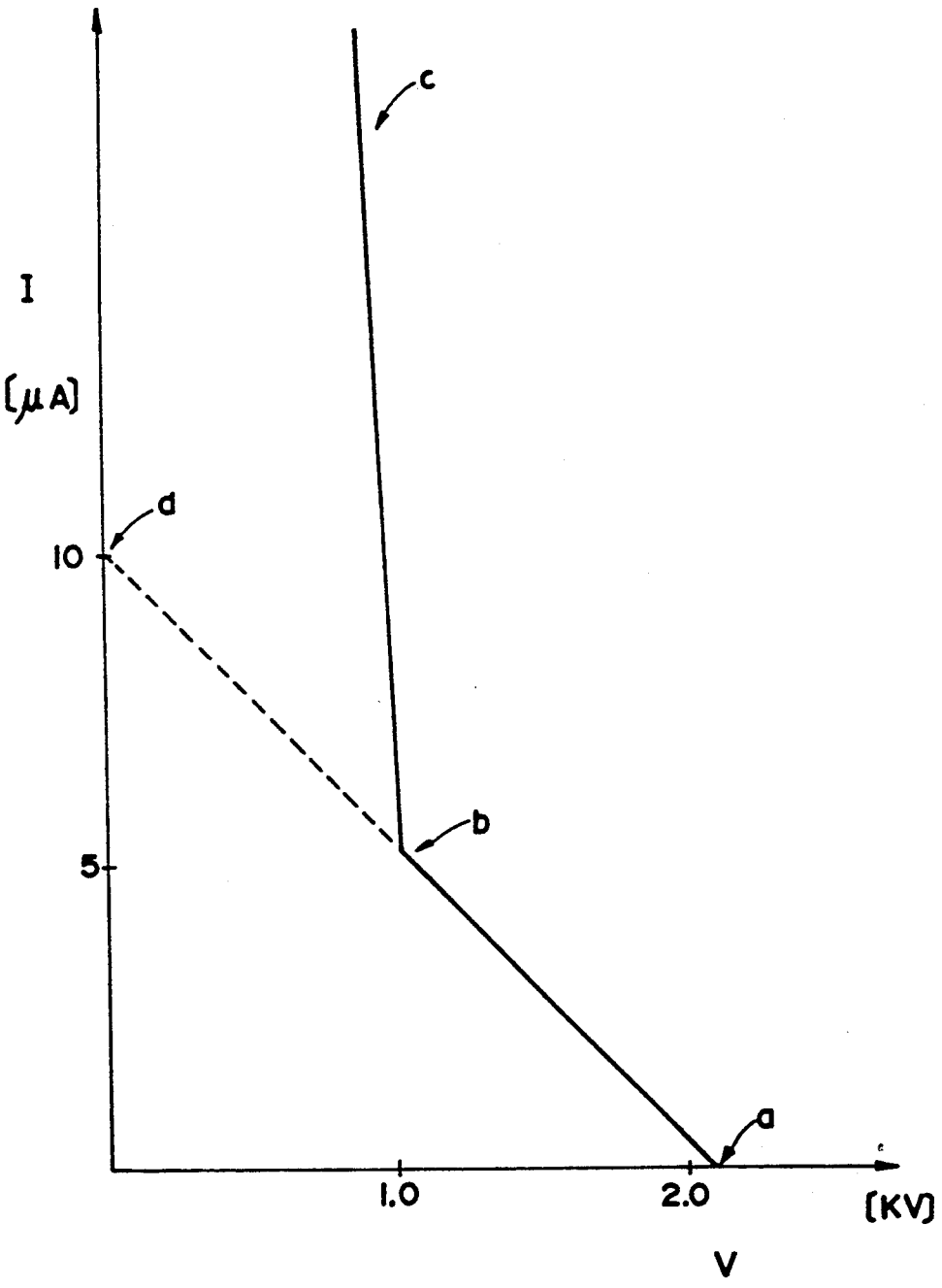
FIG. 14 is a graph showing the relationship between the current flowing through the bias circuit and the voltage applied to the transfer roller of the embodiment of FIG. 12.

FIG. 14 is a graph showing the relationship between the voltage V supplied to the shaft 161A of the transfer roller 161*a* and the current I flowing to the shaft 161A of the transfer roller 161*a* through the bias circuit 160 in the present embodiment. The abscissa of the aforesaid graph expresses the transfer voltage V supplied to the shaft 161A of the transfer roller 161*a*, and the ordinate expresses the current I flowing to the shaft 161A of the transfer roller 161*a* through the bias circuit 160.

When the operating conditions of the roller transfer device are within the range of low temperature/low humidity (10° C., 15% RH) to normal temperature/normal humidity (20° C., 60% RH), the current I flowing to the shaft 161A of the transfer roller 161a is about 6 μA or less, and the voltage V supplied to the shaft 161A of the transfer roller 161a is maintained at a value of 1.0~2.0 kV. That is, even if the current flowing to the shaft 161A of the transfer roller 161a increases or decreases, the voltage V applied to the shaft 161A automatically drops or rises to maintain the transfer current at a relatively stable level. In this case, the characteristics of the current I relative to the voltage V are represented by the solid line from point a to point b in the graph of FIG. 14.

On the other hand, when the operating conditions of the roller transfer device change from normal temperature/normal humidity to high temperature/high humidity (30° C., 85% RH), the leaking current increases as previously described. However, the voltage applied to the shaft 161A of the transfer roller 161a is not reduced to less than about 1.1 kV in the manner previously described. That is, even if the leaking current is excessive, the voltage drop of the bias resistor Rs is not greater than necessary, such that the voltage required to accomplish the transfer is applied to the shaft 161A of the transfer roller 161a. In this case the characteristics of the current I relative to the voltage V are represented by the solid line from point b to point c in the graph of FIG. 14. The characteristics of the current I relative to the voltage V in a conventional roller transfer device are represented by the solid line from point a to point b and the dashed line from point b to point d in the graph of FIG. 14.

As previously described, the present embodiment provides that a transfer current is supplied sufficient to accomplish the transfer to the recording medium 112 by supplying the required voltage for transfer (voltage of about 1 kV in the present embodiment) to the shaft 161A of the transfer roller 161a, even under operating conditions of high temperature and high humidity. Therefore, the-toner is suitably transferred to the recording medium 112 whatever operating conditions obtain.

Figure 15:
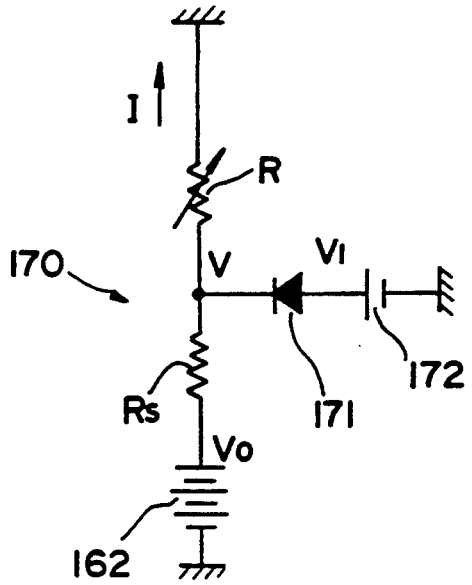
FIG. 15 shows an equivalent circuit of a modification of the roller transfer device of the second embodiment of the invention.

FIG. 15 shows an equivalent circuit of a first modification of the roller transfer device of the second embodiment of the invention. The bias circuit 170 is provided in the bias circuit 160 of the second embodiment with a diode 171 instead of the varistor 163, and a power supply 172 having an output voltage of 1.1 kV. When the voltage drop of the bias resistor Rs is large and voltage V supplied to the transfer roller 161a is 1.0 kV or less, a current flows from the power supply 172 via the diode 171. Thus, the voltage V does not fall below 1.0 kV. Other elements of construction and operation of the present modification are identical to the roller transfer device of the second embodiment and are omitted from this description.

Figure 16:
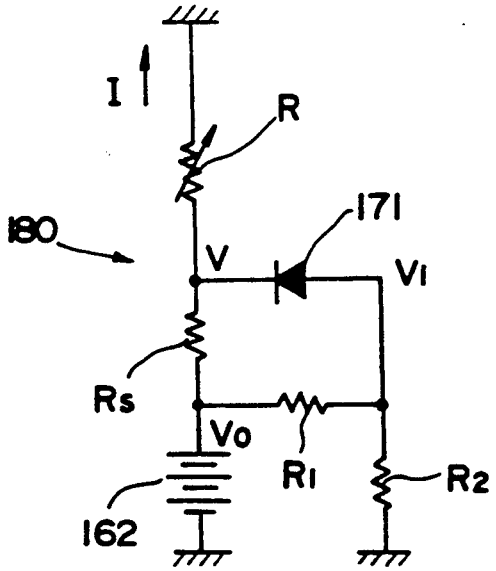
FIG. 16 shows an equivalent circuit of a further modification of the roller transfer device of the second embodiment of the invention.

FIG. 16 shows an equivalent circuit of a second modification of the roller transfer device of the second embodiment of the invention. The bias circuit 180 is provided with resistors RI and R2 instead of the power supply 172 in the bias circuit 170 of the first modification. In the bias circuit 180 the voltage V is divided by the resistors R1 and R2, and the values of the resistors R1 and R2 are set such that $V1=Vo\times R2/(R1+R2)=1.0$ kV. Other elements of construction and operation of the present modification are identical to the roller transfer device of the first modification and are omitted from this description.

Figure 17:
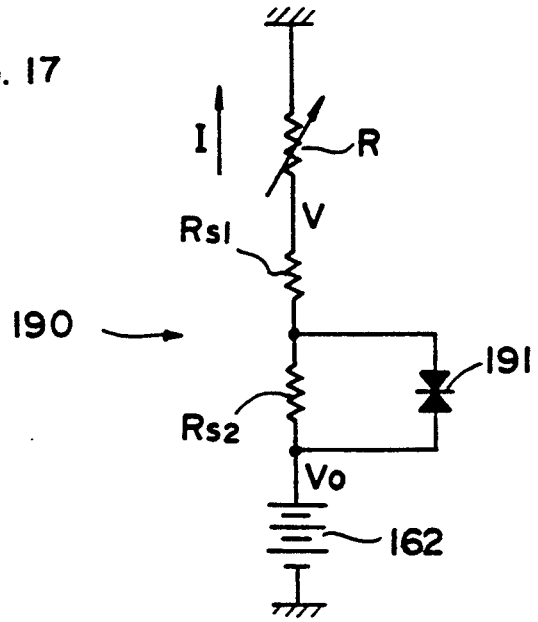
FIG. 17 shows an equivalent circuit of a still further modification of the roller transfer device of the second embodiment of the invention.

FIG. 17 shows an equivalent circuit of a third modification of the roller transfer device of the second embodiment of the invention. The bias circuit 190 is provided with serially connected bias resistor Rs1 and bias resistor Rs2, and bias resistor Rs2 connected in parallel to varistor 191 instead of the varistor Rs in the bias circuit 160 of the second embodiment. The respective resistance values of the bias resistors Rs1 and Rs2 are set so as to fulfill the relation $Rs=Rs1+Rs2$. For example, the respective resistance values of the bias resistors Rs1 and Rs2 may be $Rs1=Rs2=100$ MQ, and the varistor voltage of the varistor 191 may be about 0.55 kV. In this case, the operation of the roller transfer device of the present modification is described hereinafter with reference to FIG. 18.

Figure 18:
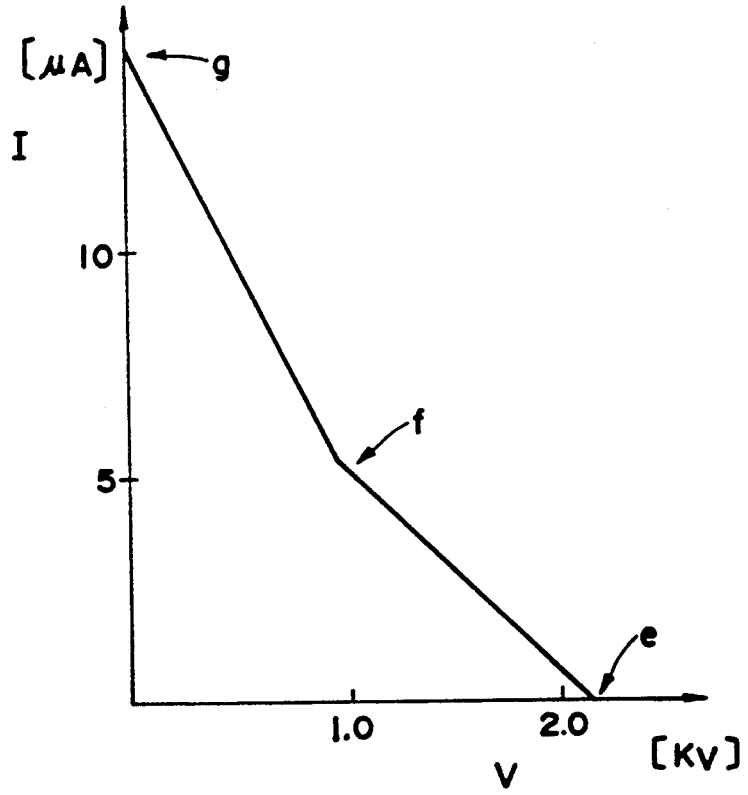
FIG. 18 is a graph showing the relationship between the current flowing through the bias circuit and the voltage applied to the transfer roller of the modification of FIG. 17.

FIG. 18 is a graph showing the relationship between the voltage V supplied to the shaft 161A of the transfer roller 161a and the current I flowing to the shaft 161A of the transfer roller 161a through the bias circuit 190 in the present embodiment. The abscissa of the aforesaid graph expresses the voltage V supplied to the shaft 161A of the transfer roller 161a, and the ordinate expresses the current I flowing to the shaft 161A of the transfer roller 161a.

As in the previous description of FIG. 14, when operating conditions of the roller transfer device were changed from low temperature/low humidity to normal temperature/normal humidity, the current flowing through the bias circuit 190 increased. The voltage V supplied to the transfer roller 161a was reduced by a voltage drop due to the combined resistance of the bias resistors Rs1 and Rs2. In this case, the relationship of the current I relative to the voltage V is expressed by the solid line from point e to point f in the graph of FIG. 18.

When the operating conditions were changed from normal temperature/normal humidity to high temperature/high humidity, the current I increased. When the voltage drop of the bias resistor Rs1 exceeded about 0.55 kV, the varistor 191 entered the ON state. When the varistor 191 was turned ON, the resistance value of the combined resistance of the bias resistors Rs1 and Rs2 may be regarded as a resistance value of only the bias resistor Rs1. Thus, the voltage drop of the bias resistors Rs1 and Rs2 is not greater than necessary, and the current necessary for the transfer is supplied to the shaft 161A of the transfer roller 161a. In this case, the characteristics of the current I relative to the voltage V are represented by the solid line from point f to point g in the graph of FIG. 18.

In the roller transfer device of the third modification, the voltage supplied to the transfer roller 161a is lower than the voltage supplied to the transfer roller 161a of the second embodiment and the first and second modifications even under conditions of high temperature and high humidity, thereby preventing excessive current flowing to the photosensitive drum 1.

Although the second embodiment of the invention has been described in terms of a roller transfer device, the invention may be applied to, for example, a charging device of the contact type for charging the surface of a photosensitive drum. In such an application, an effect identical to that of the previously described transfer roller is obtainable to prevent a reduction in the voltage supplied to a contact member and the like.

Although the present invention has been fully described by way of examples with reference to the accompanying drawings, it is to be noted that various changes and modifications will be apparent to those skilled in the art. Therefore, unless otherwise such changes and modifications depart from the scope of the present invention, they should be construed as being included therein.

What is claimed is:

1. A contact type charging device which makes contact with a surface of a charge bearing member so as to apply an electric charge to the surface in an image forming apparatus, the contact type charging device comprising:

a contact member for making contact with the charge bearing member;

a resistor serially connected to the contact member;

voltage applying means for applying a voltage to said contact member via said resistor; and regulating means for regulating an upper limit of an absolute value of the voltage applied to said contact member.

2. The contact type charging device as claimed in claim 1, wherein the resistance value of said resistor is higher than the resistance of said contact member.

3. The contact type charging device as claimed in claim 1, wherein said regulating means regulates the upper limit of the absolute value by regulating a lower limit of the voltage of the resistor.

4. The contact type charging device as claimed in claim 1, wherein said contact member is a charge brush and said charge bearing member is a photosensitive member.

5. The contact type charging device as claimed in claim 1, wherein said regulating means includes a varistor parallelly connected with said contact member.

6. A contact type charging device which makes contact with a surface of a charge bearing member so as to apply an electric charge to the surface in an image forming apparatus, the contact type charging device comprising:

a contact member for making contact with the charge bearing member;

a resistor serially connected to the contact member;

voltage applying means for applying a voltage to said contact member via said resistor; and regulating means for regulating a lower limit of an absolute value of the voltage applied to said contact member.

7. The contact type charging device as claimed in claim 6, wherein the resistance value of said resistor is higher than the resistance of said contact member.

8. The contact type charging device as claimed in claim 6, wherein said contact member is a transfer roller and said charge bearing member is a recording medium.

9. The contact type charging device as claimed in claim 6, wherein said regulating means includes a varistor parallelly connected with said resistor.

10. A contact type charging device which makes contact with a surface of a charge bearing member so as to apply an electric charge to the surface in an image forming apparatus, the contact type charging device comprising:

a contact member for making contact with the charge bearing member;

a resistor serially connected to the contact member;

voltage applying means for applying a voltage to said contact member via said resistor; and regulating means for regulating a lower limit of the voltage applied to the contact member, the regulating means including impedance which substantially becomes zero when the voltage applied to said contact member becomes lower than a predetermined value.

11. The contact type charging device as claimed in claim 10, wherein said contact member is a transfer roller and said charge bearing member is an image recording medium.

12. A contact type charging device which makes contact with a surface of a charge bearing member so as to apply an electric charge to the surface in an image forming apparatus, the contact type charging device comprising:

a contact member for making contact with the charge bearing member;

a resistor serially connected to the contact member;

voltage applying means for applying a voltage to said contact member via said resistor; and regulating means for regulating a lower limit of the voltage applied to the contact member, the regulating means including first impedance operated when the voltage applied to said contact member becomes higher than a predetermined value, and second impedance which is lower than said first impedance and is operated when the voltage applied to the contact member becomes lower than the predetermined value.

13. The contact type charging device as claimed in claim 12, wherein said contact member is a transfer roller and said charge bearing member is an image recording medium.

14. The contact type charging device as claimed in claim 8, wherein said recording medium is a paper.

15. The contact type charging device as claimed in claim 11, wherein said recording medium is a paper.

16. The contact type charging device as claimed in claim 13, wherein said recording medium is a paper.

* * * * *